US007025135B2

(12) United States Patent
Ellington et al.

(10) Patent No.: US 7,025,135 B2
(45) Date of Patent: Apr. 11, 2006

(54) THREAD INTEGRITY FEATURE FOR EXPANDABLE CONNECTIONS

(75) Inventors: Peter Ellington, Aberdeen (GB); Gary Pendleton, Stanley (GB)

(73) Assignee: Weatherford/Lamb, Inc., Houston, TX (US)

( * ) Notice: Subject to any disclaimer, the term of this patent is extended or adjusted under 35 U.S.C. 154(b) by 149 days.

(21) Appl. No.: 10/443,664

(22) Filed: May 22, 2003

(65) Prior Publication Data

US 2004/0231839 A1 Nov. 25, 2004

(51) Int. Cl.
*E21B 29/00* (2006.01)

(52) U.S. Cl. ..... 166/207; 166/206; 285/333; 285/382.4

(58) Field of Classification Search ..... 166/207, 166/206, 208, 217; 285/333, 334, 355, 382, 285/382.4, 382.5, 92
See application file for complete search history.

(56) References Cited

U.S. PATENT DOCUMENTS

| | | | | |
|---|---|---|---|---|
| 1,678,640 | A | | 7/1928 | Hall |
| 1,820,644 | A | | 8/1931 | Bach |
| 2,226,804 | A | | 12/1940 | Carroll |
| 2,341,670 | A | | 2/1944 | Stinson |
| 2,407,552 | A | | 9/1946 | Hoesel |
| 2,873,985 | A | | 1/1959 | Baldwin |
| 3,062,568 | A | | 11/1962 | Andresen et al. |
| 3,105,556 | A | | 10/1963 | Raulins |
| 3,419,079 | A | | 12/1968 | Current |
| 3,766,991 | A | | 10/1973 | Brown |
| 3,857,450 | A | | 12/1974 | Guier |
| 3,913,687 | A | | 10/1975 | Gyongyosi et al. |
| 3,989,284 | A | | 11/1976 | Blose |
| 4,076,280 | A | | 2/1978 | Young |
| 4,449,596 | A | | 5/1984 | Boyadjieff |
| 4,491,351 | A | | 1/1985 | Galle, Jr. et al. |
| 4,591,195 | A | | 5/1986 | Chelette et al. |
| 4,625,796 | A | | 12/1986 | Boyadjieff |
| 4,659,119 | A | | 4/1987 | Reimert |
| 4,703,959 | A | | 11/1987 | Reeves et al. |
| 4,712,955 | A | | 12/1987 | Reece et al. |
| 4,753,460 | A | * | 6/1988 | Tung ..... 285/331 |
| 4,754,807 | A | | 7/1988 | Lange |
| 4,771,829 | A | | 9/1988 | Sparlin |
| 4,793,422 | A | | 12/1988 | Krasner |
| 4,813,493 | A | | 3/1989 | Shaw et al. |
| 4,822,081 | A | | 4/1989 | Blose |
| 4,878,546 | A | | 11/1989 | Shaw et al. |
| 4,892,337 | A | * | 1/1990 | Gunderson et al. ..... 285/333 |
| 4,917,409 | A | | 4/1990 | Reeves |

(Continued)

FOREIGN PATENT DOCUMENTS

EP 0 659 975 A2 6/1995

(Continued)

OTHER PUBLICATIONS

EP Novelty Search Report, Application No. 04076499.5-2315, dated Sep. 13, 2004.

(Continued)

*Primary Examiner*—Frank S. Tsay
(74) *Attorney, Agent, or Firm*—Patterson & Sheridan, LLP

(57) ABSTRACT

A wellbore expandable connection, which includes a tubular pin member having an outwardly facing tapered threaded section and a tubular box member having an inwardly facing tapered threaded section. The threaded sections form a connection of a predetermined integrity when the tubular pin member is mated with the tubular box member. The integrity of the connection is substantially maintained during radial expansion of the connection.

18 Claims, 3 Drawing Sheets

U.S. PATENT DOCUMENTS

| | | | | |
|---|---|---|---|---|
| 4,985,975 | A | 1/1991 | Austin et al. | |
| 5,048,871 | A | 9/1991 | Pfeiffer et al. | |
| 5,181,570 | A | 1/1993 | Allwin et al. | |
| 5,251,709 | A | 10/1993 | Richardson | |
| 5,388,651 | A | 2/1995 | Berry | |
| 5,480,196 | A | 1/1996 | Adams, Jr. | |
| 5,520,422 | A | 5/1996 | Friedich et al. | |
| 5,782,503 | A | 7/1998 | Noel et al. | |
| 5,787,980 | A | 8/1998 | Sparlin et al. | |
| 5,855,242 | A | 1/1999 | Johnson | |
| 5,901,789 | A | 5/1999 | Donnelly et al. | |
| 5,906,398 | A | 5/1999 | Larsen et al. | |
| 5,924,745 | A | 7/1999 | Campbell | |
| 5,984,568 | A | 11/1999 | Lohbeck | |
| 6,012,522 | A | 1/2000 | Donnelly et al. | |
| 6,109,349 | A | 8/2000 | Simone et al. | |
| 6,158,507 | A | 12/2000 | Rouse et al. | |
| 6,158,785 | A | 12/2000 | Beaulier et al. | |
| 6,189,619 | B1 | 2/2001 | Wyatt et al. | |
| 6,273,634 | B1 | 8/2001 | Lohbeck | |
| 6,315,040 | B1 | 11/2001 | Donnelly | |
| 6,322,109 | B1 | 11/2001 | Campbell et al. | |
| 6,409,175 | B1 | 6/2002 | Evans et al. | |
| 6,454,013 | B1 | 9/2002 | Metcalfe | |
| 6,457,532 | B1 | 10/2002 | Simpson | |
| 6,543,816 | B1 | 4/2003 | Noel | |
| 6,607,220 | B1 * | 8/2003 | Sivley, IV | 285/334 |
| 6,685,236 | B1 | 2/2004 | Setterberg | |
| 2002/0070031 | A1 | 6/2002 | Voll et al. | |
| 2002/0163192 | A1 | 11/2002 | Coulon, et al. | |
| 2003/0024708 | A1 | 2/2003 | Ring | |
| 2003/0168858 | A1 | 9/2003 | Hashem | |
| 2003/0234538 | A1 | 12/2003 | Hashem | |
| 2004/0017081 | A1 | 1/2004 | Simpson | |

FOREIGN PATENT DOCUMENTS

| | | | |
|---|---|---|---|
| GB | 2 099 529 | A | 12/1982 |
| GB | 2 161 569 | A | 7/1985 |
| WO | WO 93/12323 | | 6/1993 |
| WO | WO 98/32948 | A1 | 7/1995 |
| WO | WO 96/37681 | A1 | 11/1996 |
| WO | WO 97/17524 | A2 | 5/1997 |
| WO | WO 98/22690 | A1 | 5/1998 |
| WO | WO 00/08301 | A2 | 2/2000 |
| WO | WO 03/048503 | A1 | 6/2003 |

OTHER PUBLICATIONS

U.S. Appl. No. 09/381,508, filed Mar. 20, 1998, Metcalfe.
U.S. Appl. No. 09/762,410, filed Aug. 9, 1999, Metcalfe.
U.S. Appl. No. 10/313,920, filed Dec. 6, 2002, Maguire.
U.S. Appl. No. 10/443,664, filed May 22, 2003, Ellington.
U.S. Appl. No. 10/663,351, filed Sep. 12, 2003, Ellington.
U.S. Appl. No. 10/664,584, filed Sep. 17, 2003, Evans et al.
U.S. Appl. No. 10/670,133, filed Sep. 24, 2003, Macaulay.
GB 0221220.7 Search Report.
GB 0215668.5 Search Report.
GB 0222321.2 Search Report.
GB 0215668.5 Search Report.
"Polytetrafluoroethylene", Encyclopedia Britannica; http://ww.search.eb.com/eb/article?eu=62273 [Accessed Oct. 22, 2002].
"Industrial polymers, major", Encyclopedia Britannica; http://ww.search.eb.com/eb/article?eu=62273 [Accessed Oct. 22, 2002].

* cited by examiner

THREAD INTEGRITY FEATURE FOR EXPANDABLE CONNECTIONS

BACKGROUND OF THE INVENTION

1. Field of the Invention

Embodiments of the present invention generally relate to wellbore completion, and more particularly, to tubular connections.

2. Description of the Related Art

In order to access hydrocarbons in subsurface formations, it is typically necessary to drill a bore into the earth. The process of drilling a borehole and of subsequently completing the borehole in order to form a wellbore requires the use of various tubular strings. These tubulars are typically run downhole where the mechanical and seal integrity of the jointed connections are critically important in the original make-up of the tubulars, during expansion of the tubulars, and after expansion of the tubulars.

Typically threaded connections are used to connect multiple tubular members end-to-end. This is usually accomplished by providing tubulars that have a simple male to female threaded connection. The male end is generally referred to as a pin, and the female end as a box. The tubulars are connected, or "made-up," by transmitting torque against one of the tubulars while the other tubular is typically held stationary. Torque is transmitted in a single direction in accordance with the direction corresponding with connection make-up. Any torque applied to the joint in the make-up direction will have the effect of continuing to tighten the threaded joint.

When running tubulars, there is sometimes a requirement to run jointed tubulars that will later be expanded by various types of expansion mechanisms. The most basic type of expander tool employs a simple cone-shaped body, which is typically run into a wellbore at the bottom of the casing that is to be expanded. The expander tool is then forced upward in the wellbore by both pulling on the working string from the surface and applying pressure below the cone. A basic arrangement of a conical expander tool is disclosed in U.S. Pat. No. 5,348,095, issued to Worrall, et al., and that patent is incorporated herein in its entirety. Pulling the expanded conical tool has the effect of expanding a portion of a tubular into sealed engagement with a surrounding formation wall, thereby sealing off the annular region therebetween. More recently, rotary expander tools have been developed. Rotary expander tools employ one or more rows of compliant rollers that are urged outwardly from a body of the expander tool in order to engage and to expand the surrounding tubular. The expander tool is rotated downhole so that the actuated rollers can act against the inner surface of the tubular to be expanded in order to expand the tubular body circumferentially. Radial expander tools are described in U.S. Pat. No. 6,457,532, issued to Simpson et al., and that patent is incorporated herein by reference in its entirety.

Tubulars to be later expanded are typically run downhole where the mechanical and seal integrity of the connections or joints are critically important both in the original and expanded state of the tubulars. The current method of making-up expandable tubulars uses threaded connections that can be applied and handled in the same way as conventional oil-field tubulars, i.e., stabbed into each other and screwed together by right hand or left hand rotation and finally torqued to establish the seal integrity. This method of connecting tubulars, though a reliable means of connecting non-expanding tubulars, is proving to be problematic when these tubulars are expanded. The reasons for this being mainly due to the changes in geometry of the connection during expansion due to the stresses applied at the threads or joint area. For instance, conventional tubulars expanded at the joint may disengage, allowing the lower tubing to fall into the wellbore.

It is well known and understood that during the expansion of solid wall tubulars, the material in the tubing wall is plastically deformed in more than just the circumferential sense. In order for a tubular to increase in diameter by plastic deformation, the material to make-up the additional circumferential section of wall in the larger diameter must come from the tubing wall itself either by reduction in wall thickness or by reduction in tubular length or a combination of both. In a plain wall section of the tubular this process will normally take place in a relatively controlled and uniform way. However, at the point of a threaded connection, the changes in wall section, such as that of the box or pin, introduce very complex and non-uniform stresses during and after expansion. These during-expansion stresses may significantly change the thread form and compromise the connection integrity both in terms of its mechanical strength as well as in terms of its sealing capability.

Therefore, a need exists for an improved tubular connection that is capable of being expanded without losing its mechanical or sealing integrity.

SUMMARY OF THE INVENTION

Embodiments of the present invention are generally directed to a wellbore expandable connection, which includes a tubular pin member having an outwardly facing tapered threaded section and a tubular box member having an inwardly facing tapered threaded section. The threaded sections form a connection of a predetermined integrity when the tubular pin member is mated with the tubular box member. The integrity of the connection is substantially maintained during radial expansion of the connection.

In one embodiment, the wall thickness of the pin member along a substantial portion of the outwardly facing threaded section is substantially constant.

In another embodiment, the wall thickness of the box member along a substantial portion of the inwardly facing threaded section is substantially constant.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
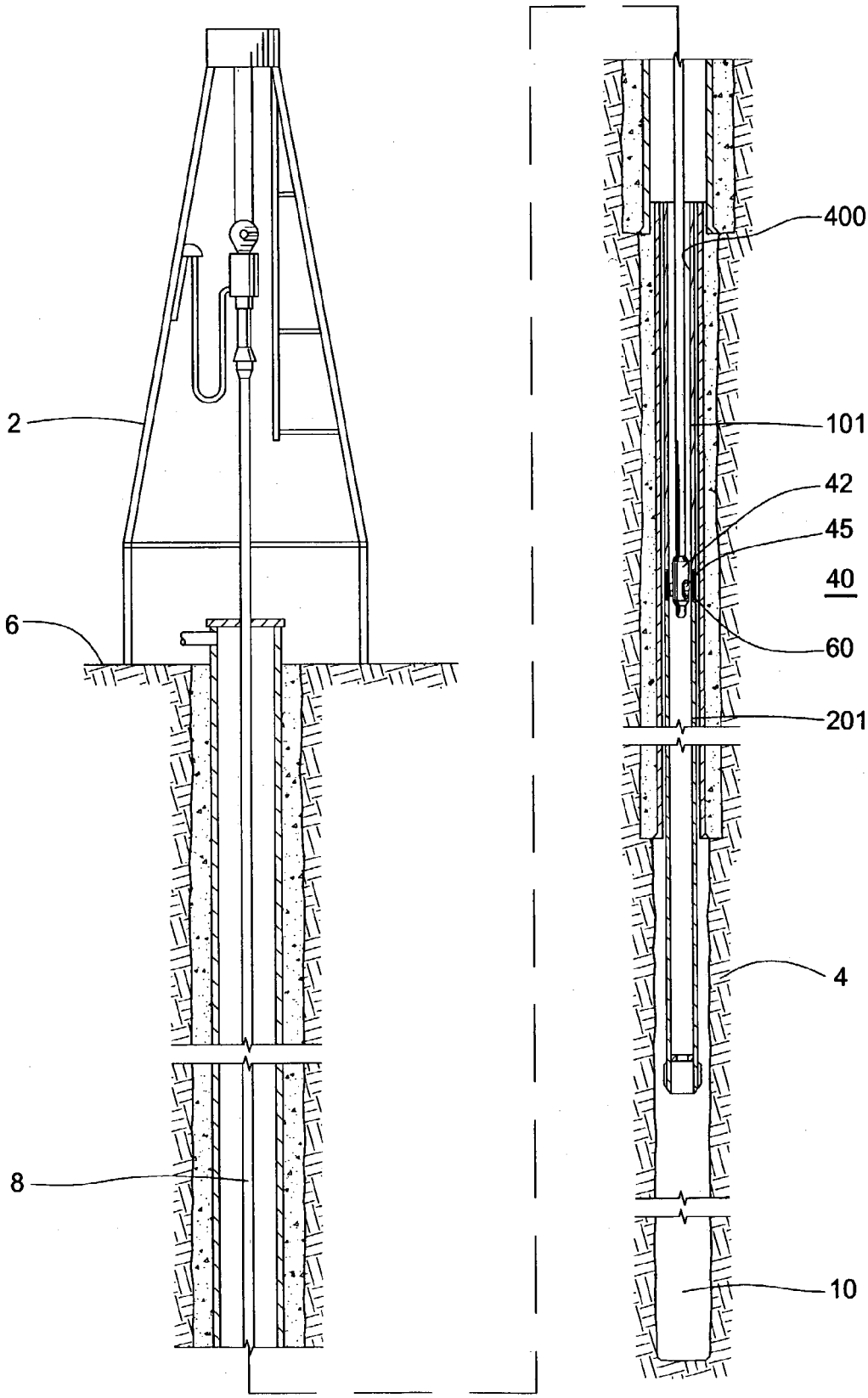
FIG. 1 is an elevation view schematically showing tubulars within a borehole and a representative expander tool at a joint between two tubulars.

FIG. 1 illustrates an embodiment of the present invention in use within a wellbore 10. Visible in FIG. 1 is a representative rig 2, a ground surface 6, a formation 4, a drill string or running string 8, a first tubular 101, a second tubular 201, a representative expander tool 40 comprising a body 42 and an expansion member 45 or roller, a bore 400 running through the tubulars, and a connection 60 or joint, between the first tubular 101 and the second tubular 201.

In operation, the first tubular 101 and the second tubular 201 are mated together at the surface 6 according to normal stab-in and threading procedures. The stab-in procedures can be preformed with tubulars arranged in a pin up and a box down configuration or a configuration with the pin down and the box up. After run-in, the tubulars can be expanded from within by any method known to those skilled in the art. The expansion process can be run in any axial and/or rotational direction within the tubulars 101, 201. As shown, a running tool with an expander tool 40 attached thereto is run up the bore 400 of the tubulars. At a desired location, an operator expands the tubulars. When the expander tool 40 reaches the connection 60 between the first tubular 101 and the second tubular 201, an internal wall of the pin portion of the second tubular 201 expands into an internal wall of the box portion of the first tubular 101. The connection 60 between the tubulars 101, 201 is capable of being expanded without losing its mechanical or sealing integrity.

Figure 2:
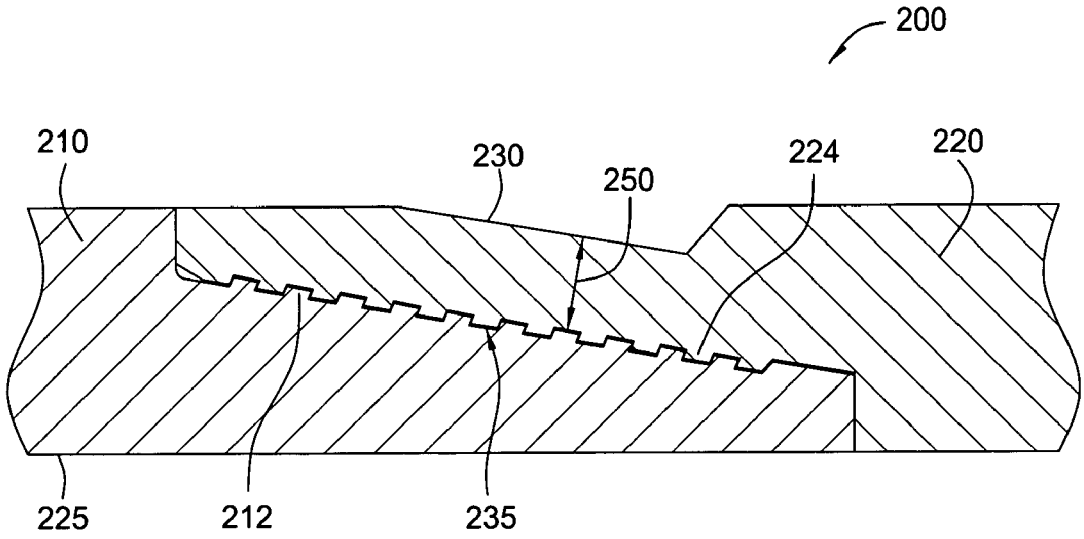
FIG. 2 illustrates a threaded connection in greater details in accordance with one embodiment of the invention.

FIG. 2 illustrates a threaded connection 200 in greater details in accordance with one embodiment of the invention. The connection 200 includes a pin member 210 formed at a threaded section of the first tubular 101 and a box member 220 formed at a threaded section of the second tubular 201. In one embodiment, the threaded sections of the pin member 210 and the box member 220 are tapered. The pin member 210 includes helical threads 212 extending along its length. The box member 220 includes helical threads 224 that are shaped and sized to mate with the helical threads 212 during the make-up of the threaded connection 200. The threaded sections of the pin member 210 and the box member 220 form the connection 200 of a predetermined integrity when the pin member 210 is mated with the box member 220. Additionally, depending upon wellbore characteristics, the threads may be coated with Teflon, an inert sealant, or other material known to those in the art for sealing purposes. The threads may be dovetail threads, as described in U.S. Pat. No. 3,989,284, issued to Blose, and that patent is incorporated herein by reference. The threads may be machined on plain end tubulars, tubulars with both ends upset, tubulars with one plain end and one end upset, or other connection types as typically used in the oil and gas industry. One of ordinary skill in the art can appreciate that embodiments of the present invention are not limited to only certain kinds of tubular ends or thread types.

In one embodiment, the box member 220 is constructed such that the wall thickness 250 of the box member 220 along a substantial portion of the threaded section is substantially constant, thereby allowing the threaded section of the box member 220 to bend in parallel with the threaded section of the pin member 210 during expansion. As such, the outer surface 230 of the box member 220 along the threaded section may be substantially in parallel with the inner surface 235 of the box member 220 along the threaded section and the outside diameter of the box member 220 along the threaded section may be less than the outside diameter of the box member 220 along the non-threaded section. In this manner, the connection 200 is capable of being radially expanded without substantially losing its mechanical or sealing integrity.

Figure 3:
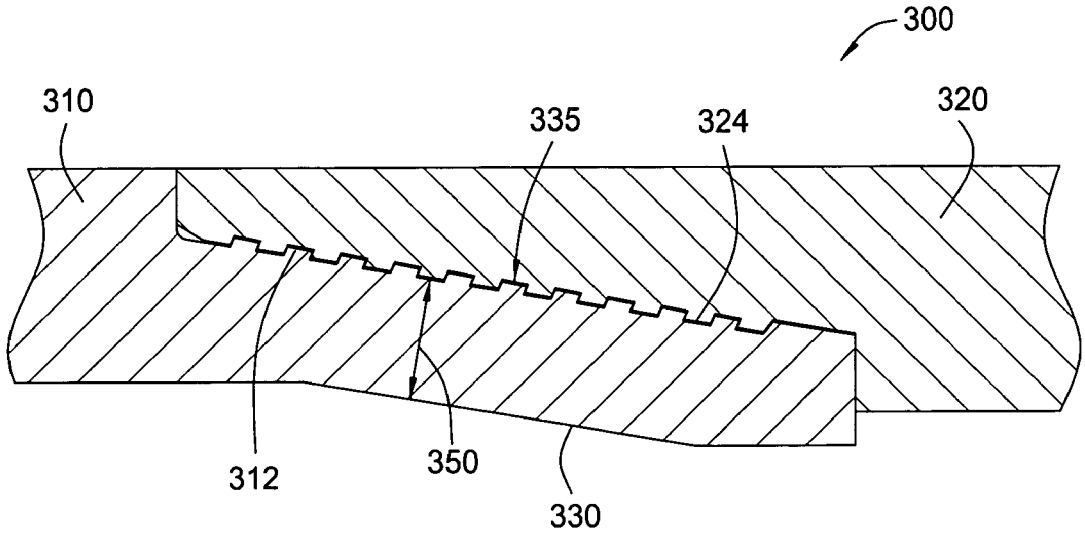
FIG. 3 illustrates a threaded connection in accordance with another embodiment of the invention.

FIG. 3 illustrates a threaded connection 300 in accordance with another embodiment of the invention. The connection 300 includes a pin member 310 formed at a threaded section of the first tubular 101 and a box member 320 formed at a threaded section of the second tubular 201. In one embodiment, the threaded sections of the pin member 310 and the box member 320 are tapered. The pin member 310 includes helical threads 312 extending along its length. The box member 320 includes helical threads 324 that are shaped and sized to mate with the helical threads 312 during the make-up of the threaded connection 300. The threaded sections of the pin member 310 and the box member 320 form the connection 300 of a predetermined integrity when the pin member 310 is mated with the box member 320. Additionally, depending upon wellbore characteristics, the threads may be coated with Teflon, an inert sealant, or other material known to those in the art for sealing purposes. The threads may be dovetail threads, as described in U.S. Pat. No. 3,989,284, issued to Blose, and that patent is incorporated herein by reference. The threads may be machined on plain end tubulars, tubulars with both ends upset, tubulars with one plain end and one end upset, or other connection types as typically used in the oil and gas industry. One of ordinary skill in the art can appreciate that embodiments of the present invention are not limited to only certain kinds of tubular ends or thread types.

The pin member 310 is constructed such that the wall thickness 350 of the pin member 310 along a substantial portion of the threaded section is substantially constant, thereby allowing the threaded section of the pin member 310 to bend in parallel with the threaded section of the box member 320 during expansion. As such, the outer surface 335 of the pin member 310 along the threaded section may be substantially in parallel with the inner surface 330 of the pin member 310 along the threaded section and the inside diameter of the pin member 310 along the threaded section may be less than the inside diameter of the pin member 310 along the non-threaded section. In this manner, the connection 300 is capable of being radially expanded without substantially losing its mechanical or sealing integrity.

Figure 4:
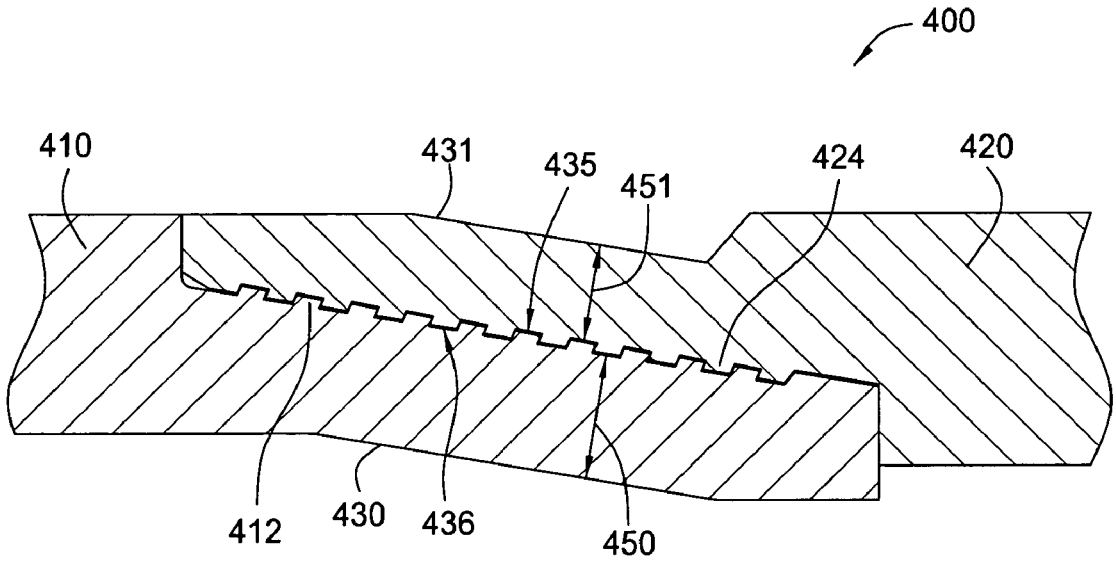
FIG. 4 illustrates a threaded connection in accordance with yet another embodiment of the invention.

FIG. 4 illustrates a threaded connection 400 in accordance with yet another embodiment of the invention. The connection 400 includes a pin member 410 formed at a threaded section of the first tubular 101 and a box member 420 formed at a threaded section of the second tubular 201. In one embodiment, the threaded sections of the pin member 410 and the box member 420 are tapered. The pin member 410 includes helical threads 412 extending along its length. The box member 420 includes helical threads 424 that are shaped and sized to mate with the helical threads 412 during the make-up of the threaded connection 400. The threaded sections of the pin member 410 and the box member 420 form the connection 400 of a predetermined integrity when the pin member 410 is mated with the box member 420. Additionally, depending upon wellbore characteristics, the threads may be coated with Teflon, an inert sealant, or other material known to those in the art for sealing purposes. The threads may be dovetail threads, as described in U.S. Pat. No. 3,989,284, issued to Blose, and that patent is incorporated herein by reference. The threads may be machined on plain end tubulars, tubulars with both ends upset, tubulars with one plain end and one end upset, or other connection types as typically used in the oil and gas industry. One of ordinary skill in the art can appreciate that embodiments of the present invention are not limited to only certain kinds of tubular ends or thread types.

The pin member 410 is constructed such that the wall thickness 450 of the pin member 410 along a substantial portion of the threaded section is substantially constant. As such, the outer surface 435 of the pin member 410 along the threaded section may be substantially in parallel with the inner surface 430 of the pin member 410 along the threaded section and the inside diameter of the pin member 410 along the threaded section may be less than the inside diameter of the pin member 410 along the non-threaded section.

The box member 420 is constructed such that the wall thickness 451 of the box member 420 along a substantial portion of the threaded section is substantially constant. As such, the outer surface 431 of the box member 420 along the threaded section may be substantially in parallel with the inner surface 436 of the box member 420 along the threaded section and the outside diameter of the box member 420 along the threaded section may be less than the outside diameter of the box member 420 along the non-threaded section. In this manner, the connection 400 is capable of being expanded without substantially losing its mechanical or sealing integrity. Although embodiments of the invention are described with reference to a box member, other types of tubular resembling a box member, such as a coupling, are also contemplated by the embodiments of the invention.

While the foregoing is directed to embodiments of the present invention, other and further embodiments of the invention may be devised without departing from the basic scope thereof, and the scope thereof is determined by the claims that follow.

What is claimed is:

1. A wellbore expandable connection, comprising:

a tubular pin member having an outwardly facing tapered threaded section; and a tubular box member having an inwardly facing tapered threaded section, wherein:

the threaded sections form a connection of a predetermined integrity when the tubular pin member is mated with the tubular box member, a wall thickness of the tubular pin member along a substantial portion of the tapered threaded section is substantially constant, and wherein the integrity of the connection is substantially maintained during radial expansion of the connection.

2. The connection of claim 1, wherein the connection defines an interface that is not parallel to a longitudinal axis of one of the tubular pin member and the tubular box member.

3. The connection of claim 1, wherein a wall thickness of the tubular box member along a substantial portion of the tapered threaded section is substantially constant.

4. The connection of claim 1, wherein an outside diameter of the tubular box member opposite at least a portion of the inwardly facing tapered threaded section is less than an outside diameter of the tubular box member opposite a non-threaded section of the tubular box member.

5. The connection of claim 1, wherein an outer surface of the tubular box member is substantially parallel with an inner surface of the tubular box member along a substantial portion of the tapered threaded section.

6. The connection of claim 1 wherein an inside diameter of the tubular pin member opposite at least a portion of the outwardly facing tapered threaded section is less than an inside diameter of the tubular pin member opposite a non-threaded section of the tubular pin member.

7. The connection of claim 1, wherein an outer surface of the tubular pin member is substantially parallel with an inner surface of the tubular pin member along a substantial portion of the tapered threaded section.

8. The connection of claim 1, wherein each tapered threaded section comprises a plurality of threads coated with a sealant.

9. A method for utilizing an expandable connection in a wellbore, comprising:

running an assembly on a tubular string into the wellbore, the assembly comprising:

a tubular pin member having an outwardly facing tapered threaded section; and a tubular box member having an inwardly facing tapered threaded section, wherein the threaded sections form a connection of a predetermined integrity when the tubular pin member is mated with the tubular box member, the integrity of the connection is substantially maintained during radial expansion of the connection, and an outer surface of the tubular pin member is substantially parallel with an inner surface of the tubular pin member along a substantial portion of the threaded section; and expanding the assembly radially outward.

10. The connection of claim 9, wherein a wall thickness of the tubular box member along a substantial portion of the tapered threaded section is substantially constant.

11. The method of claim 9, wherein an outside diameter of the tubular box member opposite at least a portion of the inwardly facing tapered threaded section is less than an outside diameter of the tubular box member opposite a non-threaded section of the tubular box member.

12. The method of claim 9, wherein an outer surface of the tubular box member is substantially parallel with an inner surface of the tubular box member along a substantial portion of the tapered threaded section.

13. The method of claim 9, wherein expanding the assembly comprises expanding at least a portion of the connection.

14. The method of claim 9, wherein expanding the assembly comprises expanding the tapered threaded sections of the tubular pin member and the tubular box member.

15. The method of claim 9, wherein a wall thickness of the tubular pin member along a substantial portion of the tapered threaded section is substantially constant.

16. The method of claim 9, wherein an inside diameter of the tubular pin member opposite at least a portion of the outwardly facing tapered threaded section is less than an inside diameter of the tubular pin member opposite a non-threaded section of the tubular pin member.

17. A wellbore expandable connection, comprising:

a tubular pin member having an outwardly facing tapered threaded section; and a tubular box member having an inwardly facing tapered threaded section, wherein the threaded sections form a connection when the tubular pin member is mated with the tubular box member, and wherein a wall thickness of the tubular pin member along a substantial portion of the outwardly facing tapered threaded section is substantially constant, and wherein the integrity of the connection is substantially maintained during radial expansion of the connection.

18. A wellbore expandable connection, comprising:

a tubular pin member having an outwardly facing tapered threaded section; and a tubular box member having an inwardly facing tapered threaded section, wherein the threaded sections form a connection when the tubular pin member is mated with the tubular box member, wherein a wall thickness of the tubular box member along a substantial portion of the inwardly facing tapered threaded section is substantially constant, and wherein the integrity of the connection is substantially maintained during radial expansion of the connection.

* * * * *